US010818218B2

(12) United States Patent
Sugihara et al.

(10) Patent No.: US 10,818,218 B2
(45) Date of Patent: Oct. 27, 2020

(54) DISPLAY DRIVER AND SEMICONDUCTOR DEVICE

(71) Applicant: LAPIS Semiconductor Co., Ltd., Yokohama (JP)

(72) Inventors: Koya Sugihara, Yokohama (JP); Atsushi Hirama, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 16/201,766

(22) Filed: Nov. 27, 2018

(65) Prior Publication Data

US 2019/0164466 A1 May 30, 2019

(30) Foreign Application Priority Data

Nov. 28, 2017 (JP) ..... 2017-227646

(51) Int. Cl.
*G09G 3/20* (2006.01)
*G09G 3/36* (2006.01)
*G09G 3/3275* (2016.01)

(52) U.S. Cl.
CPC ..... *G09G 3/2011* (2013.01); *G09G 3/3275* (2013.01); *G09G 3/3685* (2013.01); *G09G 2310/027* (2013.01); *G09G 2310/0291* (2013.01); *G09G 2320/0276* (2013.01); *G09G 2330/021* (2013.01)

(58) Field of Classification Search
CPC ..... G09G 3/3614; G09G 2310/0297; G09G 2320/0276; G09G 2320/0285
See application file for complete search history.

(56) References Cited

U.S. PATENT DOCUMENTS

2002/0126106 A1* 9/2002 Naito ..... G09G 3/3648 345/204
2015/0049073 A1* 2/2015 Morita ..... G09G 3/3614 345/211
2015/0197083 A1* 7/2015 Otsuka ..... B41J 2/04541 347/10

FOREIGN PATENT DOCUMENTS

JP 2011-154386 A 8/2011

* cited by examiner

*Primary Examiner* — Shaheda A Abdin
(74) *Attorney, Agent, or Firm* — Rabin & Berdo, P.C.

(57) ABSTRACT

A display driver includes gradation voltage generation circuits; n DA converters configured to select and output a gradation voltage corresponding to pixel data, out of the gradation voltages generated by the gradation voltage generation circuit; n amplifiers configured to independently amplify n gradation voltages outputted from the DA converters, to generate n amplified gradation voltages; and a selector configured to output the n amplified gradation voltages from n output terminals, respectively, in a normal mode. In a power save mode, one of the gradation voltage generation circuits generates a gradation voltage, and the other gradation voltage generation circuits stop. In the power save mode, the selector outputs selected one of k amplified gradation voltages from k output terminals, and opens an output terminal of each amplifier, except for an amplifier for generating the one amplified gradation voltage, out of the k amplifiers configured to generate the k amplified gradation voltages.

6 Claims, 9 Drawing Sheets

DISPLAY DRIVER AND SEMICONDUCTOR DEVICE

BACKGROUND

1. Field

The present invention relates to a display driver for driving a display device in accordance with a video signal, and a semiconductor device including the display driver.

2. Description of the Related Art

As display drivers for driving display devices, such as liquid crystal display panels and organic EL display panels, a display driver that includes a gradation voltage generation circuit and DA converters and output amplifiers the numbers of which correspond to the number of output channels is known (see, for example, Japanese Patent Application Laid-Open No. 2011-154386).

The gradation voltage generation circuit includes a ladder resistor. The ladder resistor divides a power voltage into a plurality of voltages, and outputs the voltages as a plurality of gradation voltages. The DA converters selectively output gradation voltages corresponding to luminance levels represented by image data, out of the plurality of gradation voltages. The output amplifiers apply data voltages, which are obtained by buffering the voltages outputted from the DA converters, to source lines of the display device.

By the way, portable information terminal devices, e.g., smartphones and the like, have a normal mode in which no limitation is imposed on its function and performance, and a power save mode in which limitations are imposed on a part of the function or performance to reduce a consumption of a battery, as operation modes. For example, in the power save mode, the display driver performs display with a reduced number of display gradations, in order to reduce an electric power consumption.

However, even in the display with a reduced number of display gradations, each circuit of the display driver has to operate. For example, since the gradation voltage generation circuit is constituted of three systems of circuits that generate, e.g., 256 levels of gradation voltages having gamma correction characteristics corresponding to each color (red, green, or blue), in actual fact, even if the number of display gradations is reduced, a current flows through the ladder resistor included in each circuit.

Therefore, even in the power save mode, it is difficult to significantly reduce an electric power consumption.

The present invention aims at providing a display driver and a semiconductor device that can significantly reduce an electric power consumption.

SUMMARY

A display driver according to the present invention includes: a plurality of gradation voltage generation circuits each configured to generate a plurality of gradation voltages; first to n-th DA converter circuits each configured to select and output a gradation voltage corresponding to a luminance level indicated by pixel data from the plurality of gradation voltages generated by one of the gradation voltage generation circuits; first to n-th amplifiers configured to independently amplify n gradation voltages outputted from the first to n-th DA converter circuits, to generate n amplified gradation voltages; and an output selector configured to receive a mode signal indicating a normal mode or a power save mode and to output the n amplified gradation voltages from n output terminals, respectively, when the mode signal indicates said normal mode. When the mode signal indicates the power save mode, the plurality of gradation voltage generation circuits, except for one gradation voltage generation circuit, stop generating the gradation voltages. when the mode signal indicates the power save mode, in each of divisions into which the n amplified gradation voltages are divided into groups each containing k (k is an integer of less than n) amplified gradation voltages, the output selector outputs one of k amplified gradation voltages from k output terminals, and opens an output terminal of each of the amplifiers, except for an amplifier configured to generate the one of k amplified gradation voltages, out of k amplifiers configured to generate the k amplified gradation voltages.

A semiconductor device according to the present invention includes a display driver configured to drive a display device having n number (n is an integer of 2 or more) of data lines. The semiconductor device includes: a plurality of gradation voltage generation circuits each configured to generate a plurality of gradation voltages; first to n-th DA converter circuits each configured to select and output a gradation voltage corresponding to a luminance level indicated by pixel data from the plurality of gradation voltages generated by one of the gradation voltage generation circuits; first to n-th amplifiers configured to independently amplify n gradation voltages outputted from the first to n-th DA converter circuits, to generate n amplified gradation voltages; and an output selector configured to receive a mode signal indicating a normal mode or a power save mode and to output the n amplified gradation voltages from n output terminals, respectively, when the mode signal indicates said normal mode. When the mode signal indicates the power save mode, the plurality of gradation voltage generation circuits, except for one gradation voltage generation circuit, stop generating the gradation voltages. when the mode signal indicates the power save mode, in each of divisions into which the n amplified gradation voltages are divided into groups each containing k (k is an integer of less than n) amplified gradation voltages, the output selector outputs one of k amplified gradation voltages from k output terminals, and opens an output terminal of each of the amplifiers, except for an amplifier configured to generate the one of k amplified gradation voltages, out of k amplifiers configured to generate the k amplified gradation voltages.

In the power save mode, the display driver according to the present invention stops the operation of the plurality of gradation voltage generation circuits, except for the one gradation voltage generation circuit. In the power save mode, in each of divisions into which the n amplified gradation voltages, in which the n gradation voltages obtained by DA conversions have been amplified, are divided into groups each containing k (k is an integer of less than n) amplified gradation voltages, one of k amplified gradation voltages is outputted from the k output terminals. Furthermore, the output terminal of each amplifier, except for the amplifier configured to generate the one amplified gradation voltage described above, of the k amplifiers configured to generate the k amplified gradation voltages is opened.

According to the above-described configuration, in the power save mode, the gradation voltage generation circuits, except for the one gradation voltage generation circuit, stop operating, and therefore, an output current outputted from the n amplifiers is significantly reduced, thus allowing a significant reduction in an electric power consumption.

DETAILED DESCRIPTION OF THE INVENTION

An embodiment of the present invention will be described below in detail with reference to the drawings.

Figure 1:
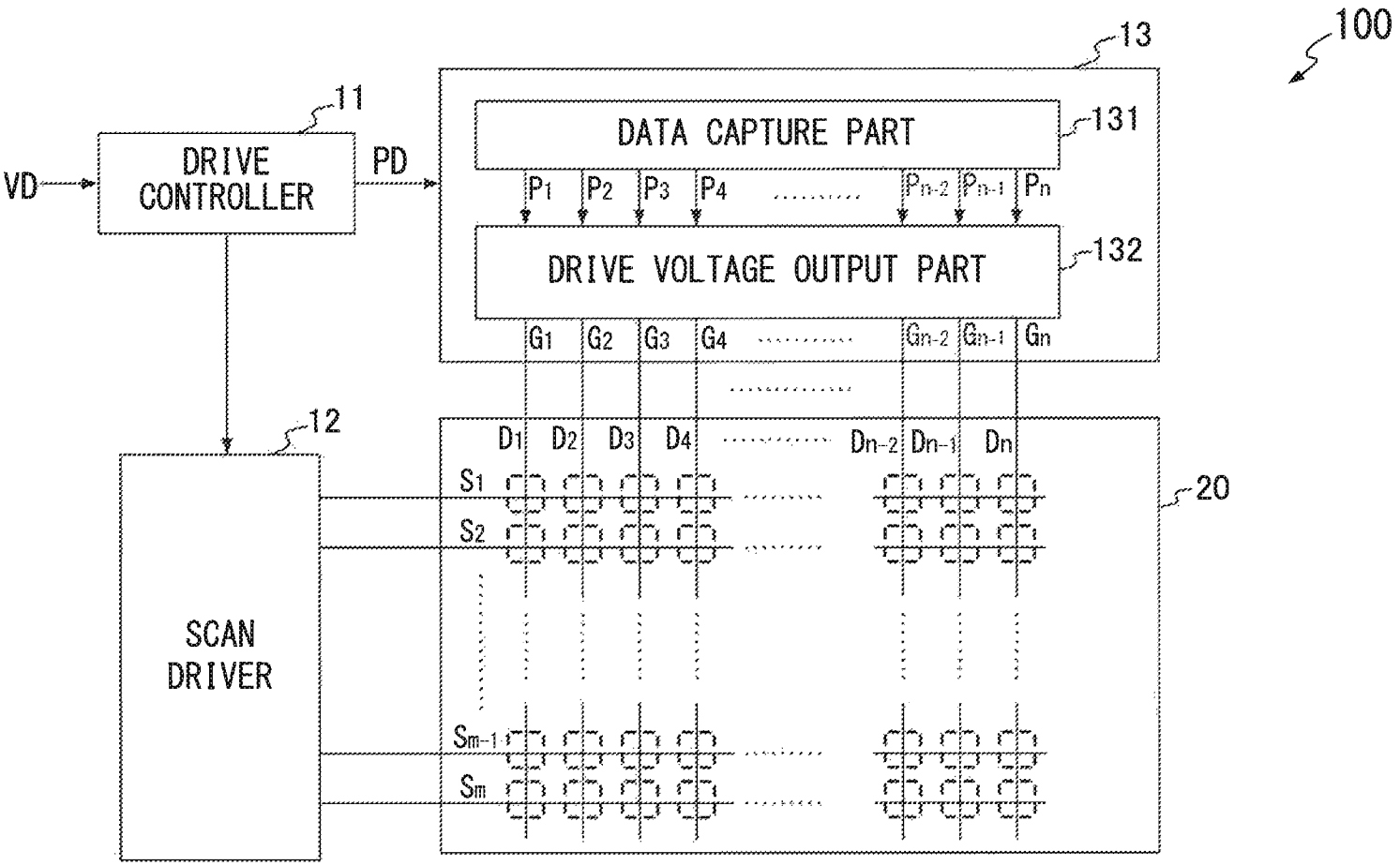
FIG. 1 is a block diagram showing a configuration of a display unit 100 including a display driver according to the present invention.

FIG. 1 is a block diagram showing a configuration of a display unit 100 including a display driver according to the present invention. As shown in FIG. 1, the display unit 100 includes a drive controller 11, a scan driver 12, a data driver 13, and a display device 20.

The display device 20 is constituted of, for example, an organic EL panel or the like. The display device 20 includes horizontal scan lines S1 to Sm (m is an integer of 2 or more) extending in a horizontal direction of a two-dimensional screen, and data lines D1 to Dn (n is an integer of 2 or more) extending in a vertical direction of the two-dimensional screen. Red display cells for displaying a red color, green display cells for displaying a green color, and blue display cells for displaying a blue color are formed in areas (areas enclosed by broken lines) at respective intersections of the horizontal scan lines and the data lines. In the display device 20, the display cells are arranged in order of, for example, a red display cell, a green display cell, a blue display cell, a green display cell, a red display cell, a green display cell, a blue display cell, a green display cell, . . . , along each horizontal scan line. At this time, the four display cells of "a red display cell, a green display cell, a blue display cell, and a green display cell" that are adjacently arranged in the horizontal direction of the two-dimensional screen constitute one pixel.

The horizontal scan lines S1 to Sm are connected to the scan driver 12. The data lines D1 to Dn are connected to the data driver 13.

The drive controller 11 detects a horizontal synchronization signal from a video signal VD, and supplies the scan driver 12 with the horizontal synchronization signal. The drive controller 11 generates an image data signal PD including a series of pixel data pieces that represent luminance levels of the pixels as, e.g., 8-bit luminance gradations, on the basis of the video signal VD, and supplies the data driver 13 with the image data signal PD.

The scan driver 12 sequentially applies a horizontal scan pulse to each of the horizontal scan lines S1 to Sm of the display device 20 at synchronized timing with the horizontal synchronization signal supplied from the drive controller 11.

The data driver 13 is formed in a semiconductor IC (integrated circuit) chip.

As shown in FIG. 1, the data driver 13 includes a data capture part 131 and a drive voltage output part 132.

The data capture part 131 captures pixel data pieces included in the image data signal PD on a horizontal scan line basis, in other words, by a number of n. The data capture part 131 supplies the drive voltage output part 132 with the captured n pixel data pieces as pixel data P1 to Pn.

The drive voltage output part 132 generates drive voltages G1 to Gn having voltage levels corresponding to the luminance levels represented by pixel data P, on the basis of the pixel data P1 to Pn, and applies the drive voltages G1 to Gn to the data lines D1 to Dn of the display device 20, respectively.

Figure 2:
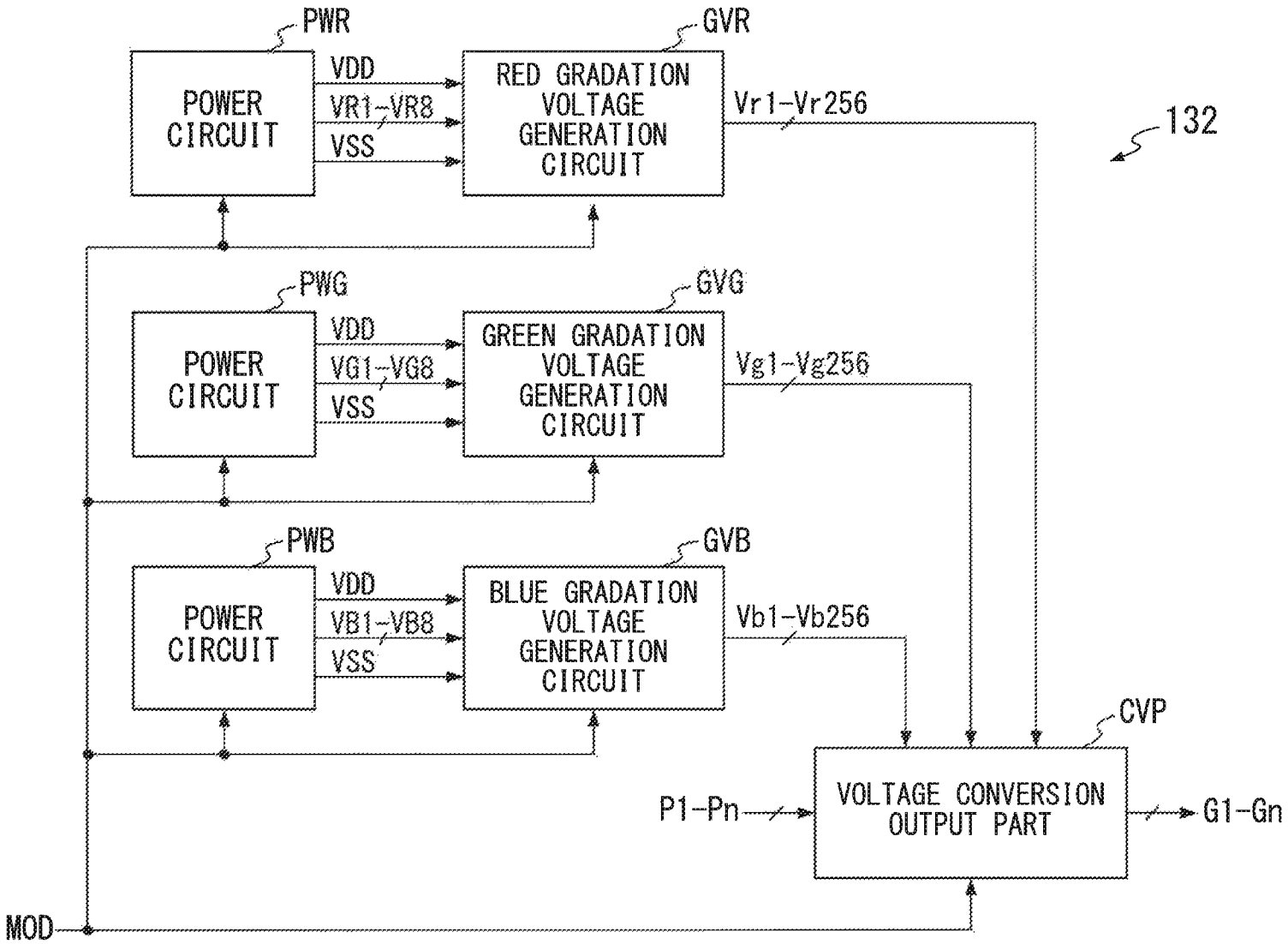
FIG. 2 is a block diagram showing an internal configuration of a drive voltage output part 132.

FIG. 2 is a block diagram showing the internal configuration of the drive voltage output part 132.

In FIG. 2, power circuits PWR, PWG, and PWB receive a mode signal MOD from a controller of an information processing device, such as a smartphone or a cellular phone, having the display unit 100. When the mode signal MOD indicates a normal mode, the power circuit PWR generates a power potential VDD, a ground potential VSS, and reference gradation potentials VR1 to VR8. Note that the reference gradation potentials VR1 to VR8 are eight potentials different from each other that are set within the range between the power potential VDD and the ground potential VSS in accordance with gamma correction characteristics corresponding to a red color.

The power circuit PWR supplies a red gradation voltage generation circuit GVR with the generated power potential VDD, ground potential VSS, and reference gradation potentials VR1 to VR8.

When the mode signal MOD indicates a power save mode, the power circuit PWR stops generating the reference gradation potentials VR1 to VR8, and supplies the red gradation voltage generation circuit GVR only with the power potential VDD and the ground potential VSS.

When the mode signal MOD indicates the normal mode, the power circuit PWG generates a power potential VDD, a ground potential VSS, and reference gradation potentials VG1 to VG8. Note that, the reference gradation potentials VG1 to VG8 are eight potentials different from each other that are set within the range between the power potential VDD and the ground potential VSS in accordance with gamma correction characteristics corresponding to a green color.

The power circuit PWG supplies a green gradation voltage generation circuit GVG with the generated power potential VDD, ground potential VSS, and reference gradation potentials VG1 to VG8.

When the mode signal MOD indicates the power save mode, the power circuit PWG stops generating the reference gradation potentials VG1 to VG8, the power potential VDD, and the ground potential VSS. In other words, in the power save mode, the power circuit PWG is in an operation stop state.

When the mode signal MOD indicates the normal mode, the power circuit PWB generates a power potential VDD, a ground potential VSS, and reference gradation potentials VB1 to VB8. Note that the reference gradation potentials VB1 to VB8 are eight potentials different from each other that are set within the range between the power potential VDD and the ground potential VSS in accordance with gamma correction characteristics corresponding to a blue color.

The power circuit PWB supplies a blue gradation voltage generation circuit GVB with the generated power potential VDD, ground potential VSS, and reference gradation potentials VB1 to VB8.

When the mode signal MOD indicates the power save mode, the power circuit PWB stops generating the reference gradation potentials VB1 to VB8, the power potential VDD, and the ground potential VSS. In other words, in the power save mode, the power circuit PWB is in an operation stop state.

Figure 3:
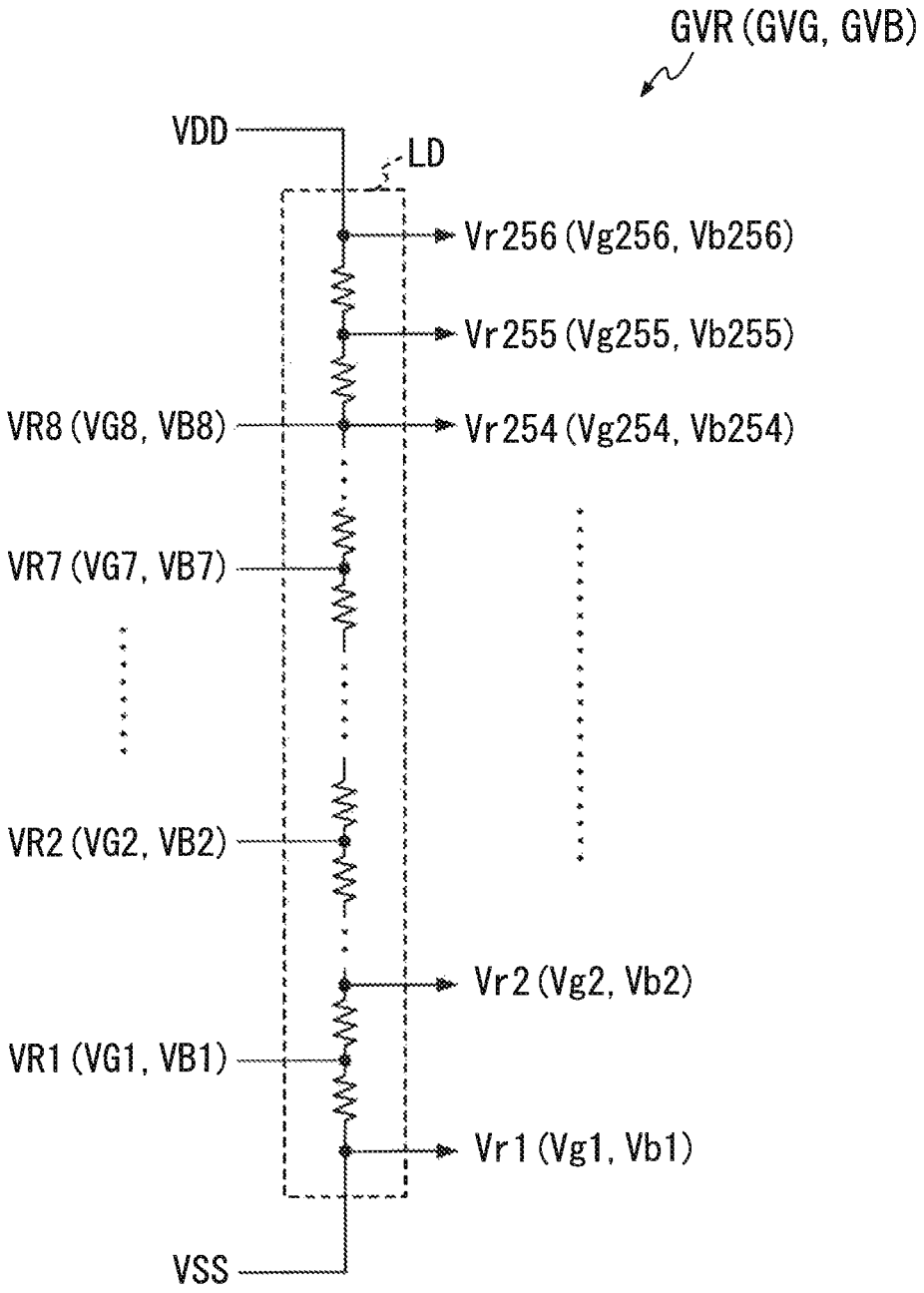
FIG. 3 is a circuit diagram of each of a red gradation voltage generation circuit GVR, a green gradation voltage generation circuit GVG, and a blue gradation voltage generation circuit GVB.

As shown in FIG. 3, each of the red gradation voltage generation circuit GVR, the green gradation voltage generation circuit GVG, and the blue gradation voltage generation circuit GVB includes a ladder resistor LD in which 255 or more resistors are connected in series.

The ladder resistor LD receives the power potential VDD at one end, and receives the ground potential VSS at the other end. Furthermore, the ladder resistor LD receives the reference gradation potentials VR1 to VR8 (VG1 to VG8, or VB1 to VB8) at eight nodes of a plurality of nodes at which the resistors are connected to each other.

In the normal mode, the red gradation voltage generation circuit GVR obtains voltages occurring at 256 nodes of the ladder resistor LD by the application of the power potential VDD, the reference gradation potentials VR1 to VR8, and the ground potential VSS, as gradation voltages Vr1 to Vr256. The red gradation voltage generation circuit GVR supplies a voltage conversion output part CVP with the gradation voltages Vr1 to Vr256, as a first gradation voltage group in which a gamma correction has been applied to the red color.

In the power save mode, the red gradation voltage generation circuit GVR supplies the voltage conversion output part CVP only with the two gradation voltages Vr1 and Vr256 out of the gradation voltages Vr1 to Vr256.

In the normal mode, the green gradation voltage generation circuit GVG obtains voltages occurring at 256 nodes of the ladder resistor LD by the application of the power potential VDD, the reference gradation potentials VG1 to VG8, and the ground potential VSS, as gradation voltages Vg1 to Vg256. At this time, the green gradation voltage generation circuit GVG supplies the voltage conversion output part CVP with the gradation voltages Vg1 to Vg256, as a second gradation voltage group in which a gamma correction has been applied to the green color.

In the power save mode, the green gradation voltage generation circuit GVG stops supplying the voltage conversion output part CVP with the gradation voltages Vg1 to Vg256.

In the normal mode, the blue gradation voltage generation circuit GVB obtains voltages occurring at 256 nodes of the ladder resistor LD by the application of the power potential VDD, the reference gradation potentials VB1 to VB8, and the ground potential VSS, as gradation voltages Vb1 to Vb256. At this time, the blue gradation voltage generation circuit GVB supplies the voltage conversion output part CVP with the gradation voltages Vb1 to Vb256, as a third gradation voltage group in which a gamma correction has been applied to the blue color.

In the power save mode, the blue gradation voltage generation circuit GVB stops supplying the voltage conversion output part CVP with the gradation voltages Vb1 to Vb256.

The voltage conversion output part CVP selects a gradation voltage corresponding to the luminance level represented by the pixel data P, on the basis of each of the pixel data P1 to Pn, from one of the first to third gradation voltage groups (Vr1 to Vr256, Vg1 to Vg256, and Vb1 to Vb256). Next, as described above, the voltage conversion output part CVP amplifies each of the n gradation voltages independently, to obtain n amplified gradation voltages. The voltage conversion output part CVP outputs n number amplified gradation voltages as drive voltages G1 to Gn. The drive voltages G1 to Gn are applied to the data lines D1 to Dn of the display device 20, respectively.

Figure 4:
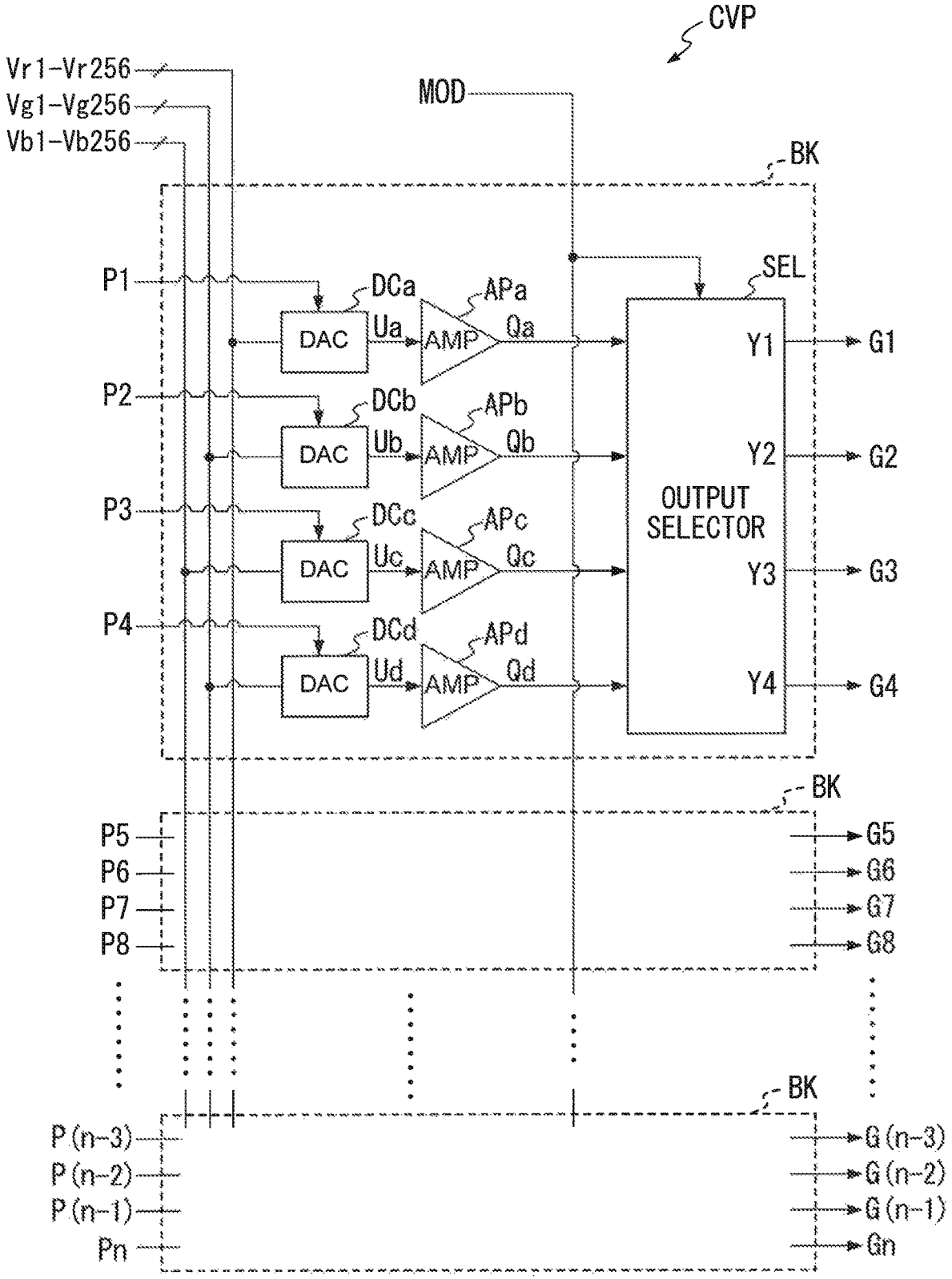
FIG. 4 is a block diagram showing an example of an internal configuration of a voltage conversion output part CVP.

FIG. 4 is a block diagram showing an example of the internal configuration of the voltage conversion output part CVP.

The voltage conversion output part CVP as illustrated in FIG. 4 includes an n/4 number of voltage conversion output blocks BK, which are obtained by dividing n number channels corresponding to the drive voltages G1 to Gn by four that is the number of the display cells (the red display cell, the green display cell, the blue display cell, and the green display cell) constituting the one pixel.

The voltage conversion output blocks BK have the same internal configuration. Taking the voltage conversion output block BK corresponding to the drive voltages G1 to G4 as an example, the internal configuration thereof will be described below.

A DA converter circuit DCa is connected to the red gradation voltage generation circuit GVR. The DA converter circuit DCa selects a gradation voltage corresponding to the luminance level of the pixel data P1 from the gradation voltages Vr1 to Vr256, which belong to the first gradation voltage group to which a red gamma correction has been applied. The DA converter circuit DCa supplies an amplifier APa with the selected gradation voltage as a gradation voltage Ua.

The amplifier APa amplifies the gradation voltage Ua with, for example, a gain of 1, and supplies an output selector SEL with the amplified voltage as an amplified gradation voltage Qa.

A DA converter circuit DCb is connected to the green gradation voltage generation circuit GVG. The DA converter circuit DCb selects a gradation voltage corresponding to the luminance level of the pixel data P2 from the gradation voltages Vg1 to Vg256, which belong to the second gradation voltage group to which a green gamma correction has been applied. The DA converter circuit DCb supplies an amplifier APb with the selected gradation voltage as a gradation voltage Ub.

The amplifier APb amplifies the gradation voltage Ub with, for example, a gain of 1, and supplies the output selector SEL with the amplified voltage as an amplified gradation voltage Qb.

A DA converter circuit DCc is connected to the blue gradation voltage generation circuit GVB. The DA converter circuit DCc selects a gradation voltage corresponding to the luminance level of the pixel data P3 from the gradation voltages Vb1 to Vb256, which belong to the third gradation voltage group to which a blue gamma correction has been applied. The DA converter circuit DCc supplies an amplifier APc with the selected gradation voltage as a gradation voltage Uc.

The amplifier APc amplifies the gradation voltage Uc with, for example, a gain of 1, and supplies the output selector SEL with the amplified voltage as an amplified gradation voltage Qc.

A DA converter circuit DCd is connected to the green gradation voltage generation circuit GVG. The DA converter circuit DCd selects a gradation voltage corresponding to the luminance level of the pixel data P4 from the gradation voltages Vg1 to Vg256, which belong to the second gradation voltage group to which a green gamma correction has been applied. The DA converter circuit DCd supplies an amplifier APd with the selected gradation voltage as a gradation voltage Ud.

The amplifier APd amplifies the gradation voltage Ud with, for example, a gain of 1, and supplies the output selector SEL with the amplified voltage as an amplified gradation voltage Qd.

The output selector SEL has output terminals Y1 to Y4 that are connected to the four data lines D of the display device 20, respectively.

In the normal mode, the output selector SEL associates the amplified gradation voltages Qa to Qd with the output terminals Y1 to Y4 so as to correspond to the arrangements of the red display cell, the green display cell, and the blue display cell arranged along each of the horizontal scan lines S formed on the display device 20.

The output selector SEL outputs a voltage associated with the output terminal Y1, out of the amplified gradation voltages Qa, Qb, Qc, and Qd, as a drive voltage G1 from the output terminal Y1, and outputs a voltage associated with the output terminal Y2 as a drive voltage G2 from the output terminal Y2. Furthermore, the output selector SEL outputs a voltage associated with the output terminal Y3, out of the amplified gradation voltages Qa, Qb, Qc, and Qd, as a drive voltage G3 from the output terminal Y3, and outputs a voltage associated with the output terminal Y4 as a drive voltage G4 from the output terminal Y4.

For example, when the correspondences between the amplified gradation voltages Qa, Qb, Qc, and Qd and the output terminals Y1 to Y4 are as follows:

Qa: Y4
Qb: Y3
Qc: Y2
Qd: Y1 the output selector SEL outputs the amplified gradation voltage Qa from the output terminal Y4 as the drive voltage G4, and outputs the amplified gradation voltage Qb from the output terminal Y3 as the drive voltage G3. Furthermore, the output selector SEL outputs the amplified gradation voltage Qc from the output terminal Y2 as the drive voltage G2, and outputs the amplified gradation voltage Qd from the output terminal Y1 as the drive voltage G1.

On the other hand, in the power save mode, the output selector SEL outputs the amplified gradation voltage Qa out of the amplified gradation voltages Qa, Qb, Qc, and Qd from the output terminals Y1 to Y4 as the drive voltages G1 to G4.

As described above, each voltage conversion output block BK includes DA converter circuits DCa to DCd for four channels and amplifiers APa to APd. In other words, the voltage conversion output part CVP includes first to n-th DA converter circuits (DC) for n channels and first to n-th amplifiers (AP).

The internal state of the drive voltage output part 132, when the mode signal MOD indicates the power save mode, will be described below with reference to an equivalent circuit shown in FIG. 5. The equivalent circuit shown in FIG. 5 omits circuits that are put into an operation stop state in the power save mode and parts of the circuit that are not involved with the power save mode, in the configuration shown in FIGS. 2 and 4.

In the power save mode, the power circuits PWG and PWB, the green gradation voltage generation circuit GVG, and the blue gradation voltage generation circuit GVB are put into an operation stop state. Therefore, each of the DA converter circuits DCb, DCc, and DCd and the amplifiers APb, APc, and APd, included in each voltage conversion output block BK, has a fixed output level.

In the power save mode, the power circuit PWR generates the power potential VDD and the ground potential VSS, and supplies the red gradation voltage generation circuit GVR with the power potential VDD and the ground potential VSS, while it stops generating the reference gradation potentials VR1 to VR8.

The red gradation voltage generation circuit GVR thereby supplies the DA converter circuit DCa of each voltage conversion output block BK with the two levels of gradation voltages Vr1 and Vr256 based on the power potential VDD and the ground potential VSS.

Figure 5:
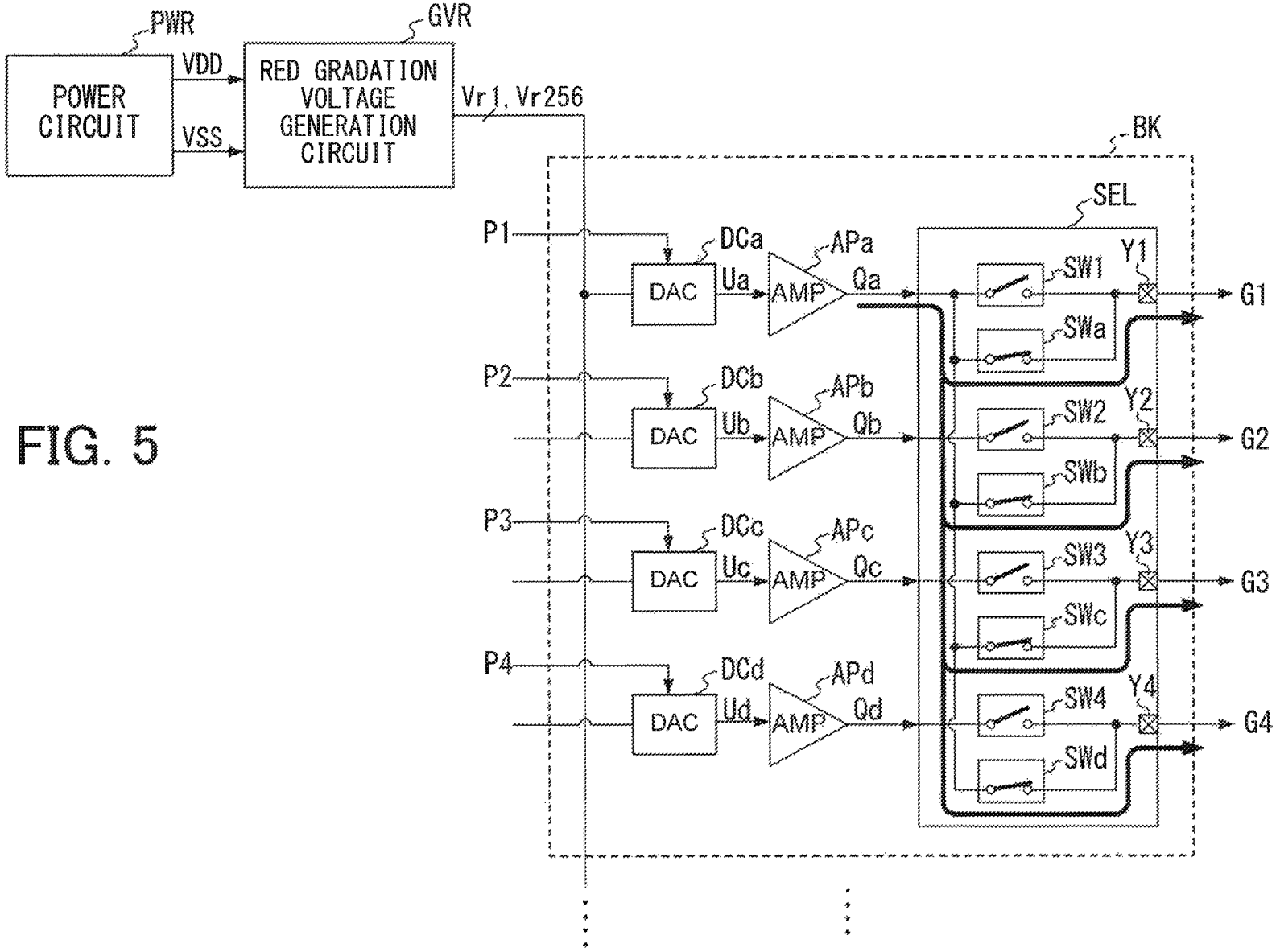
FIG. 5 is an equivalent circuit diagram showing an internal state of the drive voltage output part 132 in a power save mode.

In the power save mode, as shown in FIG. 5, both of a switch SW1, which connects between an output terminal of the amplifier APa and the output terminal Y1 in an on state, and a switch SW2, which connects between an output terminal of the amplifier APb and the output terminal Y2 in an on state, are turned off in the output selector SEL. Furthermore, in the output selector SEL, both of a switch SW3, which connects between an output terminal of the amplifier APc and the output terminal Y3 in an on state, and a switch SW4, which connects between an output terminal of the amplifier APd and the output terminal Y4 in an on state, are turned off.

In the power save mode, as shown in FIG. 5, both of a switch SWa, which connects between the output terminal of the amplifier APa and the output terminal Y1 in an on state, and a switch SWb, which connects between the output terminal of the amplifier APa and the output terminal Y2 in an on state, are turned on in the output selector SEL. Furthermore, both of a switch SWc, which connects between the output terminal of the amplifier APa and the output terminal Y3 in the on state, and a switch SWd, which connects between the output terminal of the amplifier APa and the output terminal Y4 in an on state, are turned on in the output selector SEL.

Therefore, as shown in FIG. 5, the output selector SEL puts the output terminal of each of the amplifiers APb, APc, and APd in an open state.

In the state of the output selector SEL shown in FIG. 5, the amplified gradation voltage Qa outputted from the amplifier APa is outputted through the switches SWa, SWb, SWc, and SWd and the output terminals Y1 to Y4, as shown in FIG. 5. In the power save mode, as described above, the amplified gradation voltage Qa has the gradation voltage Vr1 corresponding to a minimum luminance (black) or the gradation voltage Vr256 corresponding to a maximum luminance. Therefore, the amplified gradation voltage Qa that represents the two gradations of luminance is outputted from each of the output terminals Y1 to Y4, using the gradation voltages Vr1 and Vr256.

In an example shown in FIG. 5, the amplified gradation voltage Qa that represents the luminance level of the pixel data P1 by the two gradations is outputted as the drive voltages G1 to G4. Therefore, the display device 20 performs monochromatic black and white display in the power save mode.

As described above, in the power save mode, the operation of the green gradation voltage generation circuit GVG and the blue gradation voltage generation circuit GVB is stopped in the drive voltage output part 132, and the drive voltage output part 132 performs the monochromatic black and white display using the two gradations of gradation voltages Vr1 and Vr256 generated by the red gradation voltage generation circuit GVR.

Therefore, in the power save mode, the electric power consumption of the green gradation voltage generation circuit GVG and the blue gradation voltage generation circuit GVB becomes substantially zero.

Furthermore, in the power save mode, the output terminals of the three amplifiers APb, APc, and APd out of the four amplifiers APa to APd contained in each voltage conversion output block BK are put into the open state. Therefore, since an output current from each of the amplifiers APb, APc, and APd becomes zero, an output current from the whole n amplifiers AP is significantly reduced.

As described above, in the power save mode, two of the three gradation voltage generation circuits (GVR, GVG, and GVB) in the drive voltage output part 132 are stopped. Furthermore, since the output terminals of ¾ amplifiers (APb, APc, and APd) of each of the n amplifiers AP provided corresponding to the drive voltages G1 to Gn are open, the electric power consumption in the power save mode is significantly reduced.

In the above-described embodiment, the monochromatic black and white display is performed in the power save mode, but monochromatic color display may be performed instead.

Figure 6:
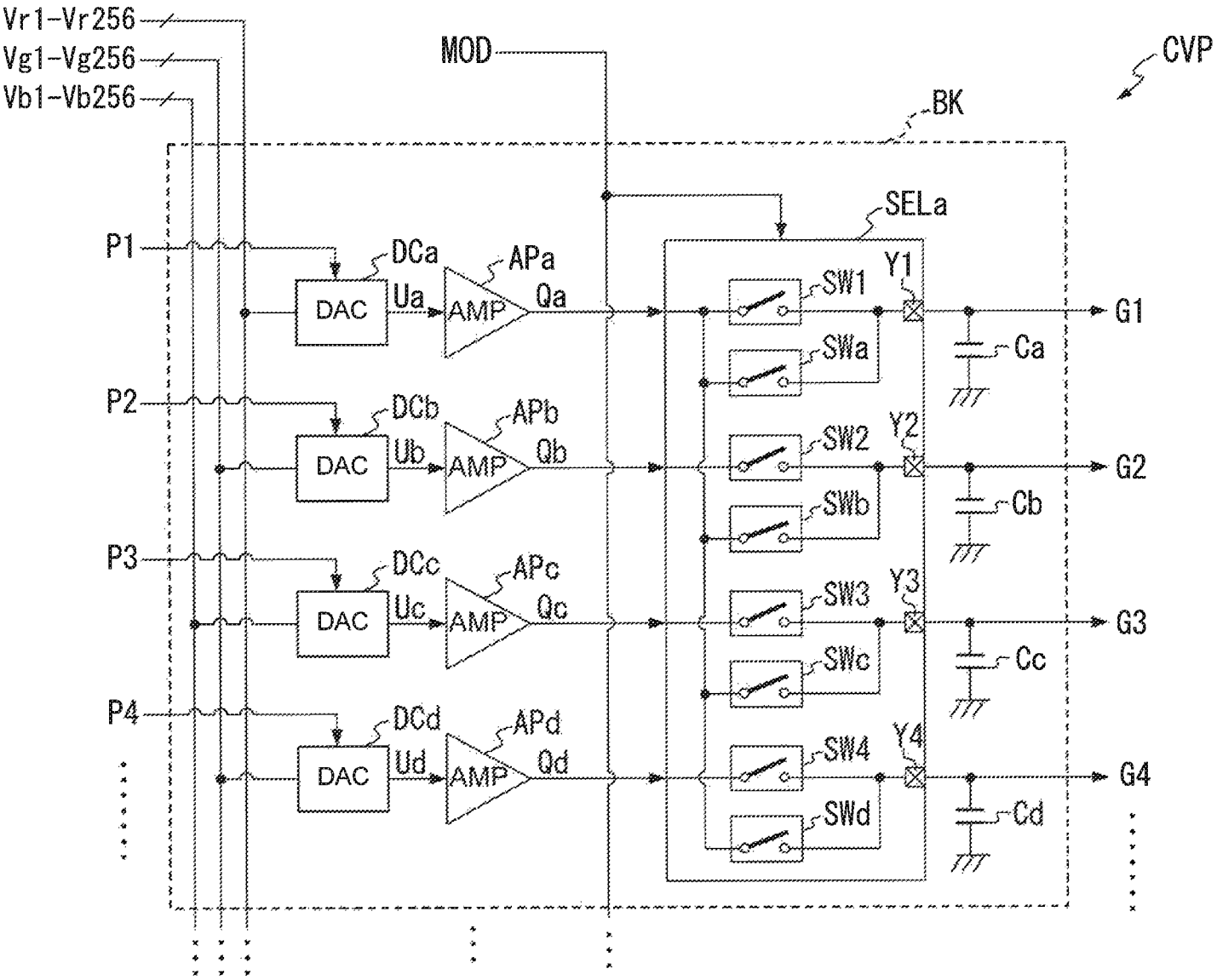
FIG. 6 is a drawing showing the internal configuration of the voltage conversion output part CVP adopted in performing monochromatic color display in the power save mode.

In the monochromatic color display, the output selector SEL included in the voltage conversion output part CVP of the configuration shown in FIGS. 2 to 4 is exchanged for an output selector SELa shown in FIG. 6. Furthermore, as shown in FIG. 6, voltage holding capacitors Ca, Cb, Cc, and Cd are connected to output terminals Y1 to Y4 of the output selector SELa, respectively.

FIG. 6 excerpts a voltage conversion output block BK that outputs drive voltages G1 to G4, out of a plurality of voltage conversion output blocks BK.

As shown in FIG. 6, the output selector SELa includes switches SW1 to SW4 and SWa to SWd, as in the case of the output selector SEL. In the normal mode, the operation of the output selector SELa is the same as that of the output selector SEL.

Figure 7:
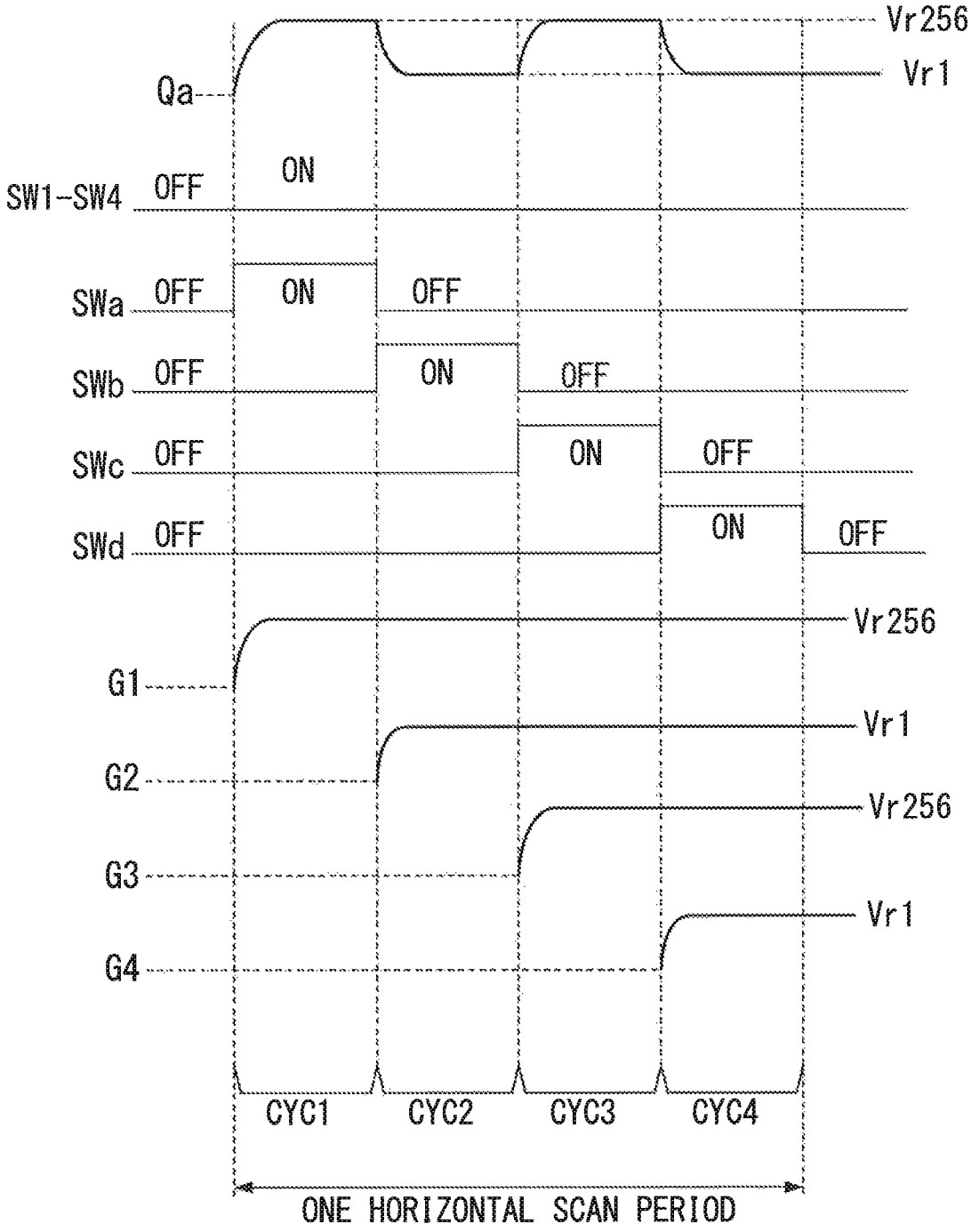
FIG. 7 is a time chart for explaining an operation of an output selector SELa.

However, in the power save mode, the output selector SELa sequentially turns on the switches SWa, SWb, SWc, and SWd one-by-one in each horizontal scan period in accordance with a time chart shown in FIG. 7, while keeping the switches SW1 to SW4 in an off state.

In other words, in a first cycle CYC1 shown in FIG. 7, the output selector SELa first turns on only the switch SWa out of the switches SWa to SWd. In the first cycle CYC1, an amplified gradation voltage Qa having, for example, a gradation voltage Vr256 is supplied.

Figure 8:
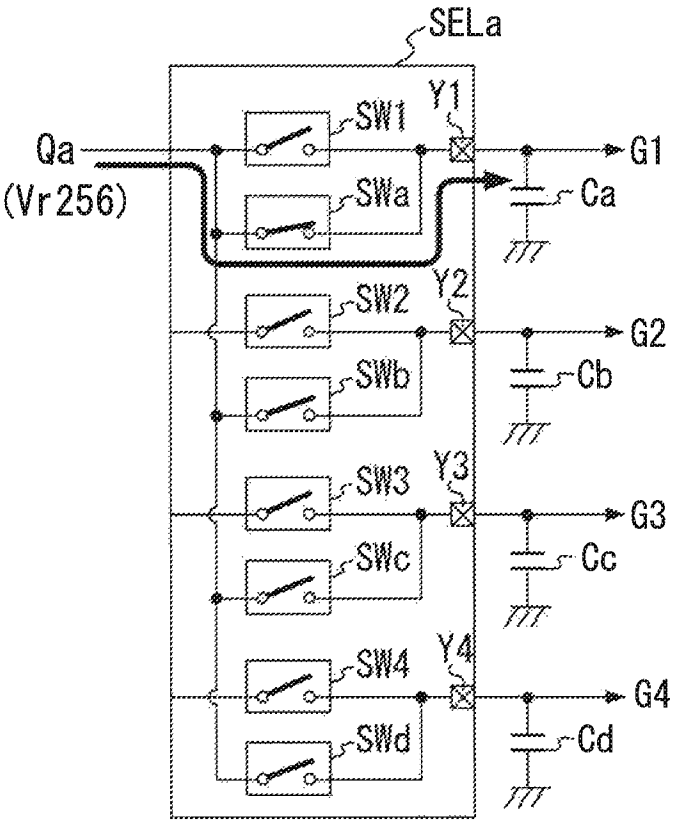
FIG. 8 is a circuit diagram showing an internal state of the output selector SELa in a first cycle CYC1.

Therefore, as shown in FIG. 8, the amplified gradation voltage Qa having the gradation voltage Vr256 corresponding to a maximum luminance is outputted as a drive voltage G1 through the switch SWa and the output terminal Y1.

Next, in a second cycle CYC2 shown in FIG. 7, the output selector SELa turns on only the switch SWb out of the switches SWa to SWd. In the second cycle CYC2, the amplified gradation voltage Qa having, for example, a gradation voltage Vr1 is supplied.

Figure 9:
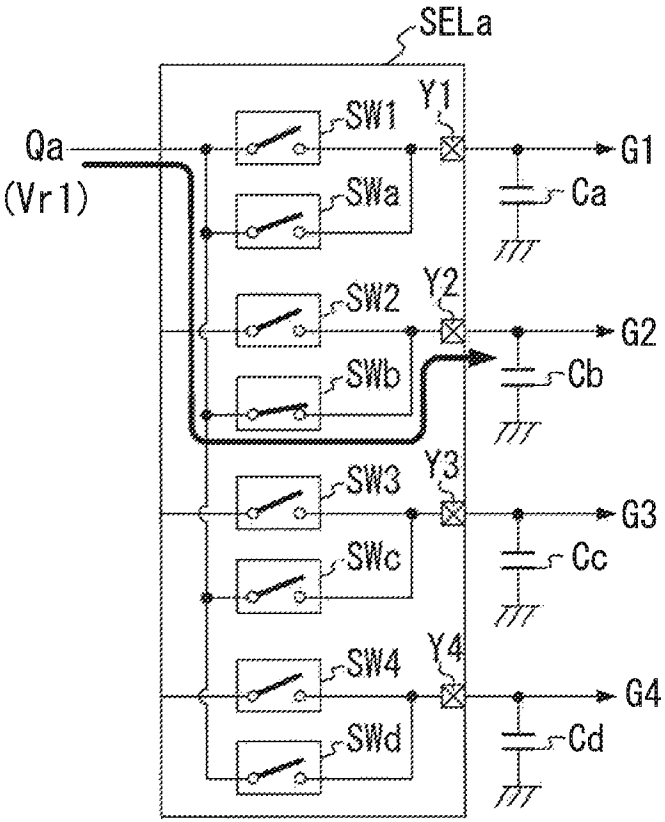
FIG. 9 is a circuit diagram showing an internal state of the output selector SELa in a second cycle CYC2.

Therefore, as shown in FIG. 9, the amplified gradation voltage Qa having the gradation voltage Vr1 corresponding to a minimum luminance is outputted as a drive voltage G2 through the switch SWb and the output terminal Y2.

Next, in a third cycle CYC3 shown in FIG. 7, the output selector SELa turns on only the switch SWc out of the switches SWa to SWd. In the third cycle CYC3, the amplified gradation voltage Qa having, for example, the gradation voltage Vr256 is supplied.

Figure 10:
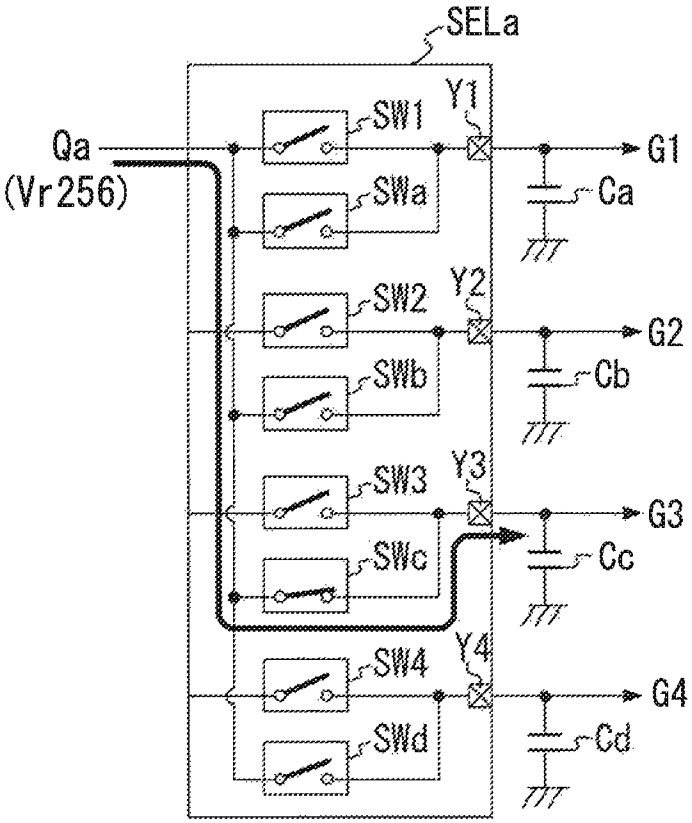
FIG. 10 is a circuit diagram showing an internal state of the output selector SELa in a third cycle CYC3.

Therefore, as shown in FIG. 10, the amplified gradation voltage Qa having the gradation voltage Vr256 corresponding to the maximum luminance is outputted as a drive voltage G3 through the switch SWc and the output terminal Y3.

Next, in a fourth cycle CYC4 shown in FIG. 7, the output selector SELa turns on only the switch SWd out of the switches SWa to SWd. In the fourth cycle CYC4, the amplified gradation voltage Qa having, for example, the gradation voltage Vr1 is supplied.

Figure 11:
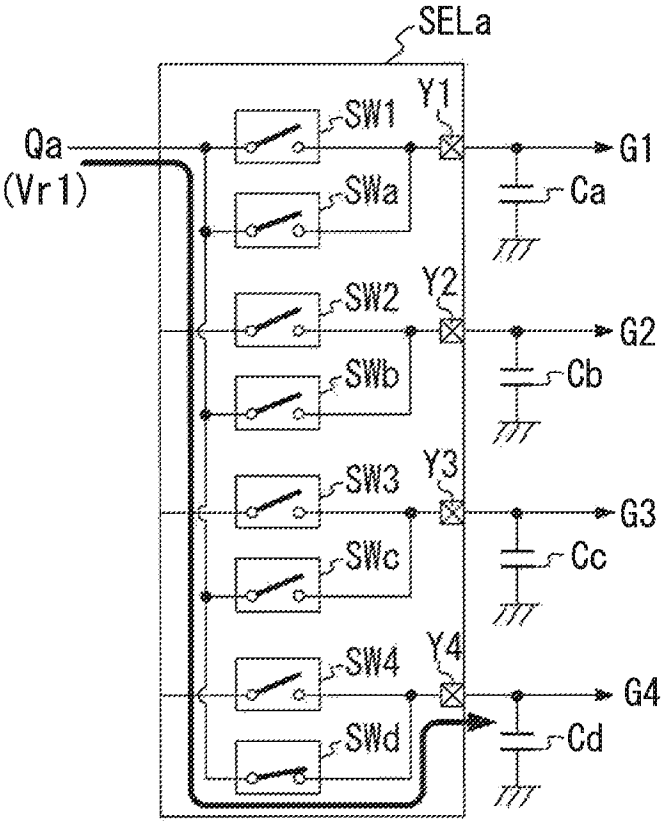
FIG. 11 is a circuit diagram showing an internal state of the output selector SELa in a fourth cycle CYC4.

Therefore, as shown in FIG. 11, the amplified gradation voltage Qa having the gradation voltage Vr1 corresponding to the minimum luminance is outputted as a drive voltage G4 through the switch SWd and the output terminal Y4.

Therefore, according to the operation shown in FIG. 7, since each drive voltage can be independently set at one of the two gradation voltages Vr1 and Vr256, the monochromatic color display of red, green, blue, or a combination color of at least two of the three colors can be performed.

The aforementioned embodiment describes the case of adopting the organic EL panel as the display device 20, but a liquid crystal display panel may be adopted instead of the organic EL panel. When the liquid crystal display panel is adopted as the display device 20, for example, one pixel is constituted of three display cells (a red display cell, a green display cell, and a blue display cell). Accordingly, for example, as the output selector SEL or SELa, a selector including switches SWa to SWc and SW1 to SW3 shown in FIG. 5 is adopted. At this time, in the normal mode, all of the switches SWa to SWc are put into an off state. On the other hand, in the power save mode, the switches SWa to SWc are under on-off control as shown in FIG. 5 or 7.

In the aforementioned embodiment, the red gradation voltage generation circuit GVR, the green gradation voltage generation circuit GVG, and the blue gradation voltage generation circuit GVB are used as the gradation voltage generation circuits, but the number of the gradation voltage generation circuits is not limited to 3, but may be 2 or 4 or more.

According to the aforementioned embodiment, in the power save mode, GVG and GVB out of the red gradation voltage generation circuit GVR, the green gradation voltage generation circuit GVG, and the blue gradation voltage generation circuit GVB are put into the stop state. However, GVR and GVB, or GVR and GVG may be put into the stop state.

In the aforementioned embodiment, the operation of the output selector SEL or SELa in the power save mode is described by taking a case where the one pixel is constituted of the four display cells (organic EL panel) or the three display cells (liquid display panel) as an example, but the number of display cells constituting one pixel is not limited to three or four. In other words, when one pixel is constituted of a k number (k is an integer less than n) of display cells, in the power save mode, the output selector SEL or SELa may output one amplified gradation voltage selected from k amplified gradation voltages, as a drive voltage, from k output terminals, in each of divisions into which the n amplified gradation voltages are divided into groups each containing k amplified gradation voltages.

In short, any driver including the following plurality of gradation voltage generation circuits, first to n-th DA converter circuits, first to n-th amplifiers, and output selector can be used as the data driver 13.

In other words, each of the gradation voltage generation circuits (GVR, GVG, and GVB) generates the plurality of gradation voltages (Vr1 to Vr256, Vg1 to Vg256, or Vb1 to Vb256). Each of the first to n-th DA converter circuits (DC) is connected to one of the plurality of gradation voltage generation circuits, and selects and outputs the gradation voltage (U) corresponding to the luminance level represented by the pixel data (P), out of the plurality of gradation voltages generated by the connected gradation voltage generation circuit. The first to n-th amplifiers (AP) independently amplify the n gradation voltages outputted from the first to n-th DA converters, and output the n amplified gradation voltages (Q). The output selector (SEL or SELa) receives the mode signal (MOD) representing the normal mode or the power save mode. When the mode signal represents the normal mode, the n amplified gradation voltages are outputted from the n output terminals (Y), respectively.

The plurality of gradation voltage generation circuits receive the mode signal (MOD). When the mode signal indicates the power save mode, one gradation voltage generation circuit (GVR) out of the plurality of gradation voltage generation circuits generates the plurality of gradation voltages (Vr1 and Vr256). When the mode signal indicates the power save mode, the other gradation voltage generation circuits (GVG and GVB), except for the one gradation voltage generation circuit, stop generating the gradation voltages. When the mode signal indicates the power save mode, the output selector outputs one amplified gradation voltage (Qa) out of the k amplified gradation voltages from the k output terminals (Y1 to Y4) for each division (BK) into which the n amplified gradation voltages are divided into groups each containing k amplified gradation voltages. Furthermore, the output selector opens the output terminal of each of the amplifiers (APb to APd), except for the amplifier (APa) for generating one amplified gradation voltage (Qa), out of the k amplifiers (APa to APd) for generating the k amplified gradation voltages.

It is understood that the foregoing description and accompanying drawings set forth the preferred embodiments of the present invention at the present time. Various modifications, additions and alternative designs will, of course, become apparent to those skilled in the art in light of the foregoing teachings without departing from the spirit and scope of the disclosed invention. Thus, it should be appreciated that the present invention is not limited to the disclosed Examples but may be practiced within the full scope of the appended claims. This application is based upon and claims the benefit of priority from the prior Japanese Patent Application No. 2017-227646 filed on Nov. 28, 2017, the entire contents of which are incorporated herein by reference.

What is claimed is:

1. A display driver configured to drive a display device having n (n is an integer of 2 or more) data lines, the display driver comprising:

a plurality of gradation voltage generation circuits each configured to receive a mode signal indicating either one of a normal mode and a power save mode, and to generate a plurality of gradation voltages in accordance with the indicating by said mode signal;

first to n-th DA converter circuits each configured to select and output a gradation voltage corresponding to a luminance level indicated by pixel data from said plurality of gradation voltages generated by one of the gradation voltage generation circuits;

first to n-th amplifiers configured to independently amplify n gradation voltages outputted from said first to n-th DA converter circuits, to generate n amplified gradation voltages; and an output selector configured to receive said mode signal and to output said n amplified gradation voltages from n output terminals, respectively, when said mode signal indicates said normal mode, said output selector including a plurality of switches, wherein when said mode signal indicates said power save mode, said plurality of gradation voltage generation circuits, except for one gradation voltage generation circuit, stop the generation of the gradation voltages by switching of the plurality of switches of the output selector, and when said mode signal indicates said power save mode, in each of divisions into which said n amplified gradation voltages are divided into groups each containing k (k is an integer of less than n) amplified gradation voltages, said output selector outputs one of k amplified gradation voltages from k output terminals, and opens an output terminal of each of the amplifiers, except for an amplifier configured to generate said one of k amplified gradation voltages, out of k amplifiers configured to generate said k amplified gradation voltages.

2. The display driver according to claim 1, wherein said output selector supplies said one of k amplified gradation voltages sequentially to said k output terminals one by one at every horizontal scan period when said mode signal indicates said power save mode.

3. The display driver according to claim 1, wherein said one gradation voltage generation circuit generates two of said gradation voltages corresponding to a minimum luminance and a higher luminance than said minimum luminance when said mode signal indicates said power save mode.

4. The display driver according to claim 1, wherein said plurality of gradation voltage generation circuits include:

a red gradation voltage generation circuit configured to generate said plurality of gradation voltages for a red color to which a red gamma correction has been applied;

a green gradation voltage generation circuit configured to generate said plurality of gradation voltages for a green color to which a green gamma correction has been applied; and a blue gradation voltage generation circuit configured to generate said plurality of gradation voltages for a blue color to which a blue gamma correction has been applied.

5. The display driver according to claim 1, wherein, in said display device, display cells are formed at intersections of a plurality of horizontal scan lines and first to n-th data lines, and k is a number of said display cells constituting one pixel.

6. A semiconductor device comprising a display driver configured to drive a display device having n (n is an integer of 2 or more) data lines, the semiconductor device comprising:

a plurality of gradation voltage generation circuits each configured to receive a mode signal indicating either one of a normal mode and a power save mode, and to generate a plurality of gradation voltages in accordance with the indicating by said mode signal;

first to n-th DA converter circuits each configured to select and output a gradation voltage corresponding to a luminance level indicated by pixel data from said plurality of gradation voltages generated by one of the gradation voltage generation circuits;

first to n-th amplifiers configured to independently amplify n gradation voltages outputted from said first to n-th DA converter circuits, to generate n amplified gradation voltages; and an output selector configured to receive said mode signal and to output said n amplified gradation voltages from n output terminals, respectively, when said mode signal indicates said normal mode, said output selector including a plurality of switches, wherein when said mode signal indicates said power save mode, said plurality of gradation voltage generation circuits, except for one gradation voltage generation circuit, stop the generation of the gradation voltages by switching of the plurality of switches of the output selector, and when said mode signal indicates said power save mode, in each of divisions into which said n amplified gradation voltages are divided into groups each containing k (k is an integer of less than n) amplified gradation voltages, said output selector outputs one of k amplified gradation voltages from k output terminals, and opens an output terminal of each of the amplifiers, except for an amplifier configured to generate said one of k amplified gradation voltages, out of k amplifiers configured to generate said k amplified gradation voltages.

* * * * *